United States Patent [19]

Gilman, Jr.

[11] 3,935,010

[45] Jan. 27, 1976

[54] ELEMENT AND PROCESS FOR SELECTIVELY FORMING POSITIVE OR NEGATIVE PHOTOGRAPHIC IMAGES

[75] Inventor: Paul B. Gilman, Jr., Rochester, N.Y.

[73] Assignee: Eastman Kodak Company, Rochester, N.Y.

[22] Filed: Sept. 3, 1974

[21] Appl. No.: 502,682

[52] U.S. Cl. ..... 96/27 E; 96/101; 96/107; 96/108; 96/120; 96/66 R; 96/63; 96/64

[51] Int. Cl.[2] .. G03C 5/04; G03C 1/28; G03C 1/36; G03C 5/30

[58] Field of Search ..... 96/101, 107, 108, 120, 96/64, 66 R, 27 E, 63

[56] References Cited

UNITED STATES PATENTS 3,772,030 11/1973 Gilman et al. ..... 96/108

OTHER PUBLICATIONS

Research Disclosure, Vol. 104, Dec. 1972, Item 10442.

*Primary Examiner*—Won H. Louie, Jr.
*Attorney, Agent, or Firm*—C. O. Thomas

[57] ABSTRACT

My invention is directed to a photographic element capable of forming either a positive or a negative image, depending upon the choice of electromagnetic wavelengths to which it is exposed. The element inludes internally fogged photographic silver halide grains which are substantially free of surface fog. Associated with the grains is a desensitizer containing an imidazoquinoxaline nucleus having a reduction potential more positive than −0.90 volts and an oxidation potential more positive than +0.80 volt. The desensitizer is present in an amount of no more than that required to cover 25 percent of the silver halide grain surfaces. Also associated with the grains is a spectral sensitizing dye having an absorption peak at least 20 nm removed from any absorption peak exhibited by the desensitizer. The photographic element is selectively exposed to electromagnetic radiation of a wavelength to which the silver halide grains are predominantly desensitized or sensitized and then developed in an internal image developer to form either a positive or a negative image.

15 Claims, No Drawings

ELEMENT AND PROCESS FOR SELECTIVELY FORMING POSITIVE OR NEGATIVE PHOTOGRAPHIC IMAGES

My invention is directed to a photographic element and to a process for its use which permits the selective formation of either positive or negative photographic images.

BACKGROUND OF THE INVENTION

Research Disclosure, Volume 104 , published December 1972, Item 10442, titled "Selective Reversal Sensitization of Spectrally Sensitized Silver Chloride", discloses a photographic element capable of forming either a positive or negative image, depending upon the wavelengths and sequence of exposures. The exposures are believed to control the surface pAg of a photographic silver chloride emulsion so as to supersensitize direct-positive image formation in the spectrally sensitized region of the spectrum or enhance the negative image-forming capability in the region of absorption of the silver chloride. In employing this approach to forming a positive or negative image no desensitizer is disclosed in association with the silver chloride emulsion.

In Gilman et al U.S. Pat. No. 3,772,030, issued Nov. 13, 1973, a photographic emulsion and element are disclosed capable of producing direct-positive photographic images with an internally fogged photosensitive silver halide having grains free of surface fog and having on the surface of the silver halide grains a desensitizing compound having a polarographic reduction potential less negative than −1.00 volt and a polarographic oxidation potential more positive than +0.76 volt. Desensitizing compounds are thought to be useful in concentrations of from 10 to 800 milligrams per mole of silver. In one optional form a sensitizing dye can be employed in combination with the desensitizer. In the only specific teachings of emulsions containing both desensitizing compounds and sensitizing dyes, the desensitizer is present in a concentration of at least 200 milligrams per mole of silver in an emulsion having an average grain size of 0.35 micron in diameter. This corresponds to an average surface coverage of approximately 50 percent of the surface area of the silver halide grains.

SUMMARY OF THE INVENTION

I have invented a photographic element of quite unexpected properties in that it is capable of selectively forming either positive or negative photographic images. I accomplish this through the use of internally fogged photographic silver halide grains which are substantially free of surface fog and which have associated with the surface of these grains a novel combination of desensitizer and a sensitizing dye. My discovery is particularly unexpected since it had previously been thought by both I and others skilled in the art, based on the investigations of similar combinations of desensitizers and sensitizing dyes, that only direct-positive images would be obtained. I have further illustrated the surprising quality of my discovery by demonstrating that desensitizers of a type considered by those skilled in the art to be generally analogous to those employed in the practice of my invention do not behave similarly in that they do not permit the selective formation of either positive or negative photographic images in the manner of my discovery.

In one aspect then, my invention is directed to a photographic element capable of forming either a positive or a negative image, depending upon the choice of electromagnetic radiation wavelengths to which it is exposed. The photographic element is comprised of a support and, as a coating thereon, a layer comprising internally fogged photographic silver bromide grains which are substantially free of surface fog. Associated with the surface of the grains is a desensitizer containing an imidazoquinoxaline nucleus having a reduction potential more positive than −0.90 volt and an oxidation potential more positive than +0.80 volt. The desensitizer is present in a desensitizing amount sufficient to cover less than 25 percent of the surface of the silver halide grains. Also associated with the surface of the silver halide grains is at least 0.5 times the amount of the desensitizer of a spectral sensitizing dye having an absorption peak at least 20 nm removed from any absorption peak exhibited by the desensitizer.

In another aspect, my invention is directed to a process of selectively forming either a positive or a negative photographic image comprising providing a photographic element as described above, selectively exposing the coating of the photographic element to electromagnetic radiation within which the silver halide grain surfaces are predominantly desensitized or selectively exposing the coating to electromagnetic radiation within a wavelength range within which the silver halide grain surfaces are predominantly sensitized and then developing with an internal image developer to form a positive image.

DETAILED DESCRIPTION OF THE INVENTION

Silver Halide

The silver halide grains employed in the practice of my invention are those which are internally fogged and which are substantially free of surface fog. Silver halide grains having internal latent image sites and which are substantially free of surface fog can also be used in the practice of my invention, provided they are uniformly exposed to produce internal fog. Exemplary of internally fogged silver halide grains which are substantially free of surface fog are those disclosed in Miller U.S. Pat. No. 3,767,413, issued Oct. 23, 1973; Luckey et al U.S. Pat. No. 2,996,382, issued Aug. 15, 1961. Davey et al U.S. Pat. No. 2,592,250, issued May 8, 1952; Porter et al U.S. Pat. No. 3,206,313, issued Sept. 14, 1965; Milton U.S. Pat. No. 3,761,266, issued Sept. 25, 1973; Ridgway U.S. Pat. No. 3,586,505, issued June 22, 1971; Gilman et al U.S. Pat. No. 3,772,030, issued Nov. 13, 1973 and Gilman et al U.S. Pat. No. 3,761,267, issued Sept. 25, 1973, disclose internal latent image emulsions that can be employed, provided they are uniformly exposed to produce internal fog. Provided the formation of surface fog is avoided, internally fogged and internal latent image emulsions useful in the practice of my invention can be formed also according to the teachings of Ives U.S. Pat. No. 2,588,982, issued Mar. 11, 1952; Falleson U.S. Pat. No. 2,497,875, issued Feb. 21, 1950; Berriman U.S. Pat. No. 3,367,778, issued Feb. 6, 1968; Illingsworth U.S. Pat. No. 3,632,340, issued Sept. 9, 1968; Evans U.S. Pat. No. 3,761,276, issued Sept. 25, 1973 and similar patents.

The silver halide grains are preferably silver bromide grains—e.g., silver bromide, silver bromoiodide, silver chlorobromide, silver chlorobromoiodide crystals and mixtures thereof. Internal image sites can be incorporated into the grains by either physical or chemical internal sensitization. Davey et al, cited above, for example, teaches the formation physically of internal image sites through the use of more than one halide. Chemical internal sensitization can be achieved through the use of sulfur, gold, selenium, tellurium and/or reduction sensitizers, as described, for example, in Sheppard et al U.S. Pat. No. 1,623,499, issued Apr. 5, 1927; Waller et al U.S. Pat. No. 2,399,083, issued Apr. 23, 1946; McVeigh U.S. Pat. No. 3,297,447, issued Jan. 10, 1967 and Dunn U.S. Pat. No. 3,297,446, issued Jan. 10, 1967. Internal latent image sites can also be formed through the incorporation of metal dopants, particularly group VIII platinum metals such as ruthenium, rhodium, palladium, iridium, osmium and platinum, as taught by Berriman, cited above, for example. In a preferred form the silver halide grains can be formed by occluding a dopant within the grains during precipitation of silver halide. In an alternate form a core grain can be formed which is treated to form the internal latent image or fog sites and then a shell deposited over the core grains, as taught by Porter et al, cited above, for example. Exposure to light can be used to fog the silver halide core grains.

In one preferred form, an internally fogged silver halide substantially free of surface fog according to the present invention can be characterized as one which when examined according to normal photographic testing techniques, by coating a test portion on a silver support with no image exposure and developing for about 5 minutes at 20°C. using Kodak Developer D-19 (surface developer) will provide a density of less than 0.4 and preferably less than 0.25. When a separate coated sample of such emulsion is developed for about 5 minutes at 20°C. in Kodak Developer D-19, additionally containing 0.50 g of potassium iodide per liter (internal developer), it will have a maximum density greater than 0.5. The compositions of Kodak Developer D-19 is as follows:

| | |
|---|---|
| N-methyl-p-aminophenol sulfate | 2.0 g |
| sodium sulfite | 90.9 g |
| hydroquinone | 8.0 g |
| sodium carbonate, monohydrated | 52.5 g |
| potassium bromide | 5.0 g |
| water to make | 1 liter. |

Desensitizer

Associated with the surface of the silver halide grains is a desensitizer containing an imidazoquinoxaline nucleus and exhibiting a reduction potential more positive than −0.90 volt and an oxidation potential more positive than +0.80 volt. The reduction potential is also known as the cathodic halfwave potential ($E_c$). The oxidation potential is also known as the anodic halfwave potential ($E_a$). In certain embodiments the useful desensitizing compounds have an anodic halfwave potential more positive than +0.90 volt and preferably more positive than +1.0 volt.

The electrochemical potential measurements can be made with an approximately $10^{-4}$ molar solution of the desensitizing compound in an electrolyte; for example, methanol which is 0.05 molar in lithium chloride. A dropping mercury electrode can be used for the cathodic measurement with the polarographic halfwave potential for the first cathodic response in potential, designated $E_c$. A pyrolytic graphite electrode can be used for the anodic measurement with the voltametric halfpeak potential for the first anodic response in potential designated $E_a$. In each meaurement, the reference electrode can be a standard Calomel electrode at 20°C. Plus and minus signs are assigned to the potential values according to the IUPAC Stockholm Convention 1953. The $E_a$ and $E_c$ values so measured shall not include processes in which electron transfer is primarily the result of the presence in solution of the counter ion of a positively charged compound or other such chemical entities in solution that are not an integral part of, or attached to, the chromophoric system of the compound. A response of lesser current magnitude preceding the primary response, such as a prewave resulting from adsorption of the electrolysis product to the electrode surface, shall be excluded from designation as $E_a$ or $E_c$.

Electrochemical measurements of the type are known in the art and are described in one or more of the following reference texts: *New Instrumental Methods in Electrochemistry*, by Delahay, Interscience Publishers, New York, New York, 1954; *Polarography*, by Kolthoff and Lingane, 2nd Edition, Interscience Publishers, New York, New York, 1952; and *Electrochemistry at Solid Electrodes*, by Adams, Marcell Dekker, Inc., New York, New York, 1969.

Imidazoquinoxaline nucleus containing desensitizers are generally known in the art and have been disclosed, for example, in Brooker and VanLare U.S. Pat. No. 3,431,111, issued Mar. 4, 1969, and Gilman et al U.S. Pat. No. 3,772,030, issued Nov. 13, 1973, the disclosure of which is here incorporated by reference. Brooker and VanLare teach the synthesis of such desensitizers while both Brooker and VanLare and Gilman et al teach the association of such desensitizers with silver halide grains.

In accordance with one embodiment of my invention, cyanine dyes are employed as desensitizers which contain an imidazo[4,5-b]quinoxaline salt moiety.

In another embodiment of my invention, cyanine dye salts are provided which comprise two nuclei joined together by a polymethine linkage, one of the nuclei being an imidazo[4,5-b]quinoxaline nucleus, which is joined through the 2-carbon atom thereof to the polymethine linkage, and a second nucleus to complete the cyanine dye. Advantageously, the second nucleus of such dyes contains a heterocyclic nitrogen atom, and the polymethine linkage is part of a polyene chain containing an equal number of alternating single and double bonds, one terminal carbon atom of the polyene chain being the 2-carbon atom of an imidazo[4,5-b]quinoxaline nucleus, the other terminal carbon atom of the polyene chain being in the second nucleus and attached to the heterocyclic nitrogen atom. Preferably, the second nucleus in these dyes is a desensitizing nucleus. As used herein and in the appended claims, "desensitizing nucleus" refers to those nuclei which, when converted to a symmetrical carbocyanine dye and added to a gelatin silver chlorobromide emulsion containing 40 mole percent chloride and 60 mole percent bromide, at a concentration of from 0.01 to 0.2 gram dye per mole of silver, cause at least an 80 percent loss in the blue speed of the emulsion when it is senistometrically exposed and developed 3 minutes at 20°C in Kodak Developer D-19. Preferably, the desensitizing nuclei are those which, when converted to a symmetrical carbocyanine dye and tested as just described, essentially completely desensitize the test emulsion to blue radiation. Substantially complete desensitization as used herein refers to nuclei which, when tested as described above, result in at least about 90 percent, and preferably more than a 95 percent, loss of speed to blue radiation. Nitrosubstituted heterocyclic nuclei of the type used in cyanine dyes are typical desensitizing nuclei.

In another embodiment of my invention, merocyanine dyes are employed comprising two nuclei joined together through an acyclic methine group which is part of a polyene chain containing an equal number of alternating single and double bonds, one of the terminal atoms of the polyene chain being the 2-carbon atom of an imidazo[4,5-b]quinoxaline nucleus, and the other terminal carbon atom of the polyene chain being a second heterocyclic ring and attached to an extracyclic carbonylic oxygen atom.

In still another embodiment of my invention, styryl dyes are provided comprising an imidazo[4,5-b]quinoxaline nucleus joined to a para-alkylamino benzene ring through an acyclic polyene chain containing an equal number of single and double bonds, one terminal atom of the polyene chain being the 2-carbon atom of said imidazo[4,5-b]quinoxaline nucleus, the other terminal carbon atom being in the benzene ring and attached to the nitrogen atom of the para-aminoalkyl group.

In a further embodiment of my invention, cyanine dyes are provided comprising two imidazo[4,5-b]quinoxaline nuclei joined together through a polyene chain containing a equal number of alternating single and double bonds, the terminal carbon atoms of the polyene chain being the 2-carbon atoms, respectively, of the imidazo [4,5-b] quinoxaline nuclei. Preferably, the polyene chain of these dyes is composed of five carbon atoms.

Desensitizers useful in the practice of my invention include those represented by the following general formulas:

(I)

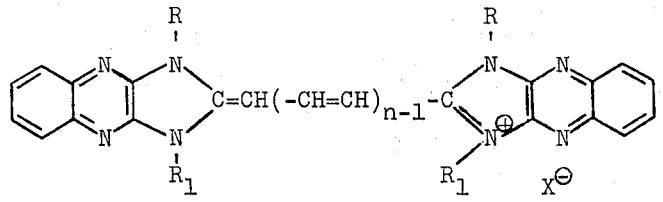

(II)

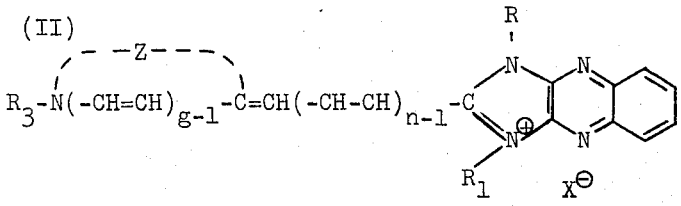

(III)

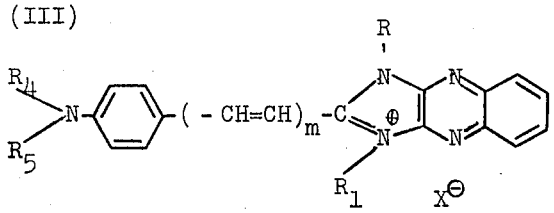

and (IV)

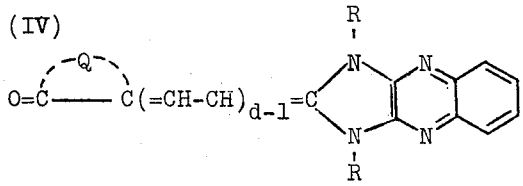

wherein $n$ represents a positive integer of from 2 to 4, $m$ and $g$ each represents a positive integer of from 1 to 2, $d$ represents a positive integer of from 1 to 3, R and $R_1$ each represents a substituent independently selected from the group consisting of an acyclic hydro-carbon substituent, such as an alkyl group (including substituted alkyl), preferably containing from 1 to 18 carbon atoms, e.g., methyl, ethyl, propyl, isopropyl, butyl, sec-butyl, hexyl, cyclohexyl, dodecyl, octadecyl, hydroxyalkyl (e.g. $\beta$-hydroxyethyl, $\gamma$-hydroxypropyl, etc.), and alkenyl substituents, preferably containing 1 to 18 carbon atoms, such as allyl, 1-propenyl, 2-propenyl, 1-butenyl, 2-butenyl and 3-butenyl, etc.; alkaryl substituents such as benzyl and $\beta$-phenylethyl; and aryl substituents (preferably containing 6 to 10 carbon atoms), e.g., phenyl, p-tolyl, o-tolyl, 3,4-dichlorophenyl, etc., groups; $R_3$ represents an alkyl group of from 1 – 12 carbon atoms, e.g., methyl, $\gamma$-sulfopropyl, isopropyl, butyl, secbutyl, γ-sulfobutyl, dodecyl, β-hydroxyethyl, γ-hydroxypropyl, β-methoxyethyl, β-ethoxyethyl, allyl, benzyl, β-phenylethyl, β-carboxyethyl, carboxymethyl, γ-carboxypropyl, β-acetoxyethyl, γ-acetoxypropyl, carbomethoxymethyl, carboxyethoxyethyl, etc., groups; $R_4$ and $R_5$ each represents the same or different alkyl group of from 1 – 6 carbon atoms, e.g., methyl, ehtyl, 2-cyanoethyl, propyl, isopropyl, butyl, hexyl, etc., groups, $X^-$represents an acid ion, e.g., chloride, bromide, iodide, thiocyanate, sulfamate, methyl sulfate, ethyl sulfate, perchlorate, p-toluenesulfonate, etc., Z represents the nonmetallic atoms required to complete a heterocyclic nucleus containing from 5 to 6 atoms in the heterocyclic ring, which may also include, in addition to the hetero nitrogen atom, a second hetero atom such as an oxygen atom, a sulfur atom, a selenium atom, or a second nitrogen atom, such as the atoms required to complete a thiazole nucleus (e.g., thiazole, 4-methylthiazole, 4-phenylthiazole, 5-methylthiazole, 5-phenylthiazole, 4,5-dimethylthiazole, 4,5-diphenylthiazole, 4-(2-thienyl)-thiazole, etc.); a benzothiazole nucleus (e.g., benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 4-phenylbenzothiazole, 5-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole, 5-ethoxybenzothiazole, tetrahydrobenzothiazole, 5,6-dimethoxybenzothiazole, 5,6-dioxymethylenebenzothiazole, 5-hydroxybenzothiazole, 6-hydroxybenzothiazole, etc.); a naphthothiazole nucleus (e.g., α-naphthothiazole, β-naphthothiazole, 5-methoxy-β-naphthothiazole, 5-ethoxy-β-naphthothiazole, 8-methoxy-α-naphthothiazole, 7-methoxy-α-naphthothiazole, etc.); a thianaphtheno-7′,6′,4,5-thiazole nucleus (e.g., 4′-methoxythianapthene-7′,-6′,4,5-thiazole, etc.); an oxazole nucleus (e.g., 4-methoxyloxazole, 5-methyloxazole, 4-phenyloxazole, 4,5-diphenyloxazole, 4-ethyloxazole, 4,5-dimethyloxazole, 5-phenyloxazole, etc.); a benzoxazole nucleus (e.g., benzoxazole, 5-chlorobenzoxazole, 5-methylbenzoxazole, 5-phenylbenzoxazole, 6Methylbenzoxazole, 5,6-dimethylbenzoxazole, 4,6-dimethylbenzoxazole, 5-methoxybenzoxazole, 5-ethoxybenzoxazole, 6-chlorobenzoxazole, 6-methoxybenzoxazole, 5-hydroxybenzoxazole, 6-hydroxybenzoxazole, etc.); a naphthoxazole nucleus (e.g., α-naphthaxazole, β-naphthoxazole, etc.); a selenazole nucleus (e.g., 4-methylselenazole, 4-phenylselenazole, etc.); a benzoselenazole nucleus (e.g., benzoselenazole, 5-chlorobenzoselenazole, 5-methoxybenzoselenazole, 5-hydroxybenzoselenazole, tetrahydrobenzoselenazole, etc.); a naphthoselenazole nucleus (e.g., α-naphthoselenazole, β-naphthoselenazole, etc.); a thiazole nucleus (e.g., thiazoline, 4-methylthiazoline, etc.); a 2quinoline nucleus (e.g., quinoline, 3-methylquinoline, 5-methylquinoline, 7-methylquinoline, 8-methylquinoline, 6-chloroquinoline, 8-chloroquinoline, 6-methoxyquinoline, 6-ethoxyquinoline, 6-hydroxyquinoline, 8-hydroxyquinoline, etc.); a 4-quinoline nucleus (e.g., quinoline, 6-methoxyquinoline, 7-methylquinoline, 8-methylquinoline, etc.); a 1-isoquinoline nucleus (e.g., isoquinoline, 3,4-dihydroisoquinoline, etc.); a 3-isoquinoline nucleus (e.g., isoquinoline, etc.); a 3,3-dialkylindolenine nucleus (e.g., 3,3-dimethylinodlenine, 3,3,5-trimethylindolenine, 3,3,7-trimethylindo'enine, etc.); a 2-pyridine nucleus (e.g., Pyridine, 3-methylpyridine, 4-methylpyridine, 5-methylpyridine, 3,4-dimethylpyridine, 4-chloropyridine, 3-hydroxypyridine, etc.); a 4-pyridine nucleus (e.g., 2-methylpyridine, 3-methylpyridine, 3chloropyridine, 2,6-dimethylpyridine, 3-hydroxy-pyridine, etc.); a 1-alkylimidazole nucleus (e.g., 1-methylimidazole, 1-ethyl-4-phenylimidazole, 1-butyl-4,5-dimethylimidazole, etc.); a 1-alkylbenzimidazole nucleus (e.g., 1-methylbenzimidazole, 1-butyl-4-methylbenzimidazole, 1-ethyl-5,6-dichlorobenzimidazole, etc.); and a 1-alkylnaphthimidazole nucleus (e.g., 1-ethyl-α-naphthimidazole, 1-methyl-β-naphthimidazole, etc.); and, Q represents the non-metallic atoms required to complete a 5 to 6 membered heterocyclic nucleus, typically containing a hetero atom selected from nitrogen, sulfur, selenium, and oxygen, such as a 2-pyrazolin-5-one nucleus (e.g., 3-methyl-1-phenyl-2-pyrazolin-5-one, 1-phenyl-2-pyrazolin-5-one, 1-(2-benzothiazolyl)-3-methyl-2-pyrazolin-5-one, etc.); an isoxazolone nucleus (e.g., 3-phenyl-5(4H)-isoxazolone, 3-methyl-5-(4H)-isoxazolone, etc.); an oxindole nucleus (e.g., 1-alkyl-2,3-dihydro-2-oxindoles, etc.); a 2,4,6-triketohexahydropyrimidine nucleus (e.g., barbituric acid of 2-thiobarbituric acid as well as their 1-alkyl (e.g., 1-methyl-1-ethyl, 1-propyl, 1-heptyl, etc.) or 1,3-dialkyl (e.g., 1,3-dimethyl, 1,3-diethyl, 1,3-dipropyl, 1,3-diisopropyl, 1,3-dicyclohexyl, 1,3-di(β-methoxy-ethyl), etc., or 1,3-diaryl (e.g., 1,3-diphenyl, 1,3-di(p-chlorophenyl), 1,3-di(p-ethoxycarbonylphenyl), etc.), or 1-aryl (e.g., 1-phenyl, 1-p-ethoxycarbonylphenyl), etc. or 1-alkyl-3-aryl (e.g., 1-ethyl-3-phenyl, 1-n-heptyl-3-phenyl, etc.) derivatives); a rhodanine nucleus (i.e., 2-thio-2,4-thiazolidinedone series), such as rhodanine, 3-alkylrhodanines (e.g., 3 -ethrylrhodanine, 3-allylrhodanine, etc.), 3-carboxyalkylrhodanines (e.g., 3-(2-carboxyethyl)rhodanine, 3-(4-carboxybutyl)rhodanine, etc.), 3-sulfoalkylrhodanines (e.g., 3-(2-sulfoethyl)rhodanine, 3-(3-sulfopropyl)rhodanine, 3-(4-sulfobutyl)-rhodanine, etc.), or 3-arylrhodanines (e.g., 3-phenylrhodanine, etc.), etc.; a 2(3H)-imidazo-[1,2-a]-pyridone nucleus; a 5,7-dioxo-6,7-dihydro5-thiazolo[3,2-a]-pyrimidine nucleus (e.g., 5,7-dioxo-3-phenyl-6,7-dihydro-5-thiazolo[3,2-a]pyrimidine, etc.); a 2-thio-2,4-oxazolidinedione nucleus (i.e., those of the 2-thio-2,4(3H,5H)-oxazoledione series) (e.g., 3-ethyl-2-thio-2,4-oxazolidinedione, 3-(2-sulfoethyl)-2-thio-2,4-oxazolidione, 3-(4-oxazolidione, 3(4-sulfobutyl)-2-thio-2,4-oxazolidinedione, 3-(3-carboxypropyl)-2-thio-2,4-oxazolidinedione, etc.); a thianaphthenone nucleus (e.g., 3-(2H)-thianaphthenone, etc.); a 2-thio-2,5-thiazolidinedione nucleus (i.e., the 2-thio-2,5-(3H,4H)-thiazoledione series) (e.g., 3-ethyl-2-thio-2,5-thiazolidinedione, etc.); a 2,4-thiazolidinedione nucleus (e.g., 2,4-thiazolidinedione, 3-ethyl-2,4-thiazolidinedione, 3-phenyl-2,4-thiazolidinedione, 3-α-naphthyl2,4-thiazolidinedione, etc.); a thiazolidinone nucleus (e.g., 4-thiazolidinone, 3-ethyl-4-thiazolidinone, 3-phenyl-4-thiazolidione, 3-α-naphthyl-4-thiazolidinone, etc.); a 2-thiazolin-4-one series (e.g., 2-ethylmercapto-2-thiazolin-4-one, 2-alkylphenylamino-2-thiazolin-4-one, 2-diphenylamino-2-thiazolin-4-one, etc.); a 2-imino-4-oxazolidinone (i.e., pseudohydantoin) nucleus; a 2,4-imidazolidinedione (hydantoin) series (e.g., 2,4-imidazolidinedione, 3-ethyl-2,4-imidazolidinedione, 3-phenyl-2,4-imidazolidinedione, 3-α-naphthyl-2,4-imidazolidinedione, 1,3-diethyl-2,4-imidazolidinedione, 1-ethyl-3-phenyl-2,4-imidazolidinedione, 1-ethyl-3-α-naphthyl-2,4-imidazolidinedione, 1,3-diphenyl-2,4-imidiazolidinedione, etc.); a 2-thio-2,4-imidazolidinedione (i.e., 2-thiohydantoin) nucleus (e.g., 2-thio-2,4-imidazolidinedione, 3-ethyl-2-thio-2,4-imidazolidinedione, 3-(4-sulfobutyl)-2-thio-2,4-imidazolidinedione, 3-(2-carboxyethyl)-2 -thio-2,4-imidazolidinedione, 3-phenyl-2-thio-2,4,-imidazolidinedione, 3-α-naphthyl-2-thio-2,4-imidazolidinedione, 1,3-diethyl-2-thio-2,4-imidazolidinedione, 1-ethyl-3-phenyl-2-thio-2,4-imidazolidinedione, 1-ethyl-3-α-naphthyl-2,4-imidazolidinedione, 1,3-diphenyl-2-thio2,4-imidazolidinedione, etc.); a 2-imidazolin-5-one nucleus (e.g., 2-propylmecapto-2-imidazolin-5-one, etc.), etc. (especially useful are nuclei wherein Q represents a hetrocyclic nucleus containing 5 atoms in the heterocyclic ring, 3 of said atoms being carbon atoms, 1 of said atoms being a nitrogen atom, and 1 of said atoms being selected from the group consisting of a nitrogen atom, an oxygen atom, and a sulfur atom).

The imidazo[4,5-b]quinoxaline nucleus in the dyes of this invention can contain various substituents, such as at least one halogen substituent, e.g., chloro or bromo, dichloro, etc.; nitro; cyano; or, a fused aryl ring (such as phenyl) to provide, for example, an 8H-benzo[f]imidazo[4,5-b]quinoxaline nucleus. Dyes which contain a nitro, a mono- or a di-chloro substituted imidazo[4,5-b]quinoxaline nucleus are of particular advantage in fogged direct-positive photographic silver halide emulsions. Such nitro- or chloro-substituted dyes have an unexpectedly sharp absorption peak and in addition impart an unexpected increase in speed. Halogen substituted dyes (such as chloro substituted dyes) provide unexpected improved overall results (as compared to the nonhalogen substituted analogs) in direct-positive emulsions with respect to speed, higher $D_{max}$ or lower $D_{min}$.

It is well known in the art that very small quantities of an imidazoquinoxaline nucleus containing dye are effective to desensitize completely silver halide grains. For example, Gilman et al U.S. Pat. No. 3,772,030 teaches the use of as little as 10 mg of desensitizer per mole of silver. I have discovered quite unexpectedly that if a properly chosen sensitizing dye is employed in combination with the desensitizer, if the oxidation and reduction potentials of the desensitizer are properly chosen, if the desensitizer contains at least one imidazoquinoxaline nucleus and if the quantity of the desensitizer is limited so that no more than 25 percent of the surface of the silver halide grains are covered by the desensitizer, it is then possible to obtain either positive or negative images, depending upon selection of exposure and development conditions. The quantity of desensitizer necessary to provide a 25 percent grain coverage for a given silver halide can be calculated readily by those skilled in the art from a knowledge of the grain size, distribution and habit of the silver halide. For example, 100 mg of a desensitizer according to formula (I) above per mole of a monodispersed octahedral silver bromide having an average grain diameter of 0.35 micron provides a grain coverage of 25 percent. Effective desensitization of silver halide grains for purposes of this invention can be achieved by covering as little as one or two percent of the effective surface area of silver halide grains.

Spectral Sensitizing Dyes

Conventional spectral sensitizing dyes for negative working silver halide emulsions can be employed in the practice of this invention. It is generally preferred that the spectral sensitizing dye have a reduction potential more negative than −0.90 volt and an oxidation potential less positive than +1.00 volt. In order to facilitate the production of dense negative images it is preferred that the sensitizing dye be present in an amount of at least 0.5 times, on a mole basis, that of the desensitizer. Further, in order to avoid direct interference of the sensitizing dye and the desensitizer it is preferred that the sensitizing dye have an absorption peak at least 20 nm (most preferably at least 50 nm) removed from any absorption peak exhibited by the desensitizer. Generally, the more widely separated the absorption peaks of the sensitizing dye and the desensitizer the greater will be the exposure latitude in terms of wavelengths to obtain either positive or negative images.

Exemplary spectral sensitizers which can be used include those cyanines, merocyanines, complex (tri or tetranuclear merocyanines, complex (tri or tetranuclear) cyanines, holopolar cyanines, styryls, hemicyanines (e.g., enamine hemicyanines), oxonols and hemioxonols which do not adversely affect the direct-positive materials. Dyes of the cyanine classes can contain such basic nuclei as the thiazolines, oxazolines, pyrrolines, pyridines, oxazoles, thiazoles, selenazoles and imidazoles. Such nuclei can contain alkyl, alkylene, hydroxyalkyl, sulfoalkyl, carboxyalkyl, aminoalkyl and enamine groups and can be fused to carbocyclic or heterocyclic ring systems either unsaturated or substituted with halogen, phenyl, alkyl, haloalkyl, cyano or alkoxy groups. The dyes can be symmetrical or unsymmetrical and can contain alkyl, phenyl, enamine or heterocyclic substituents on the methine or polymethine chain.

Merocyanine dyes can contain the basic nuclei mentioned above a well as acid nuclei such as thiohydantoins, rhodanines, oxazolidinediones, thiazolidinediones, barbituric acids, thiazolineones, and malononitriles. These acid nuclei can be substituted with alkyl, alkylene, phenyl, carboxyalkyl, sulfoalkyl, hydroxyalkyl, alkoxyalkyl, alkylamino groups or heterocyclic nuclei. Combinations of these dyes can be used if desired. In addition certain supersensitizing addenda which do not absorb visible light can be included, for instance halogenated dyes as described in U.S. Pat. No. 3,501,309 and stilbenes as described in U.S. Pat. No. 2,933,390.

Exemplary preferred spectral sensitizing dyes useful in the practice of my invention and procedures for associating these dyes with silver halide grains are disclosed in Gilman et al U.S. Pat. No. 3,772,030, cited above.

Photographic Elements and Their Use

The silver halide grains with the desensitizer and the sensitizing dye associated therewith can be formed into a photographic element of any conventional construction. In a preferred form the silver halide grains are present in a photographic silver halide emulsion. In this form the silver halide grains are dispersed in gelatin or another conventional dispersing vehicle. Various conventional photographic addenda, such as antifoggants and stabilizers, developing agents, hardeners, plasticizers, lubricants, coating aids, matting agents, brighteners and the like, can be incorporated into the emulsion. One or more silver halide containing layers according to my invention can be coated onto a support, alone or in combination with conventional subbing layers, interlayers and overlayers to form the completed photographic element. Antistatic layers and antihalation layers can also be present. The construction of exemplary photographic elements is fully disclosed in the various patents cited and incorporated by reference above and in *Product Licensing Index*, Volume 92, published December 1971, publication 9232, the disclosure of which is here incorporated by reference.

Depending upon the specific choice of the desensitizer and the sensitizing dye, either positive or negative photographic images can be obtained by exposing the photographic layers of my invention to actinic radiation of a wavelength corresponding to an absorption peak exhibited by either the desensitizer or the sensitizing dye. Such absorption peaks can lie at any desired location within the electromagnetic spectrum, including the infrared, the visible, the ultraviolet and the X-ray portions of the spectrum, provided, of course, that the spectral sensitizing dye and the desensitizer exhibit distinctly separated absorption peaks—preferably at least 20 nm and most preferably at least 50 nm. By exposing a sample of a photographic element formed according to my invention using a wedge spectrograph and then developing, it is possible to readily identify those portions of the spectrum over which a positive image and a negative image is obtainable as well as those transition portions of the spectrum in which the sensitizing dye and desensitizer interfer so that no image or only a weak image is obtained. The positive image-producing portions of the spectrum are visible as fog bleached areas while the negative image-producing portions of the spectrum are visible as darkened areas. Depending on the distribution of absorption peaks, separated bands of the spectrum can exist that produce desirable positive and/or negative images. Once the optimum regions of the spectrum have been identified for obtaining negative and positive images of maximum density, radiation sources can be selected or filters selected to permit selective exposure so that positive or negative images are obtained, as desired.

One particularly useful application of my invention is in forming photographs which are composites of positive and negative images. For example, a portion of a graphic subject can be produced as a positive and the remaining portion reproduced as a negative by exposing my photographic element to the subject sequentially using a portion of the spectrum for one exposure to which my element responds as a negative-working element and a portion of the spectrum for the other exposure to which my element responds as a positive-working element. For one exposure all portions of the subject are blanked out, except those intended to be reproduced as a negative, while for the remaining exposure that portion of the subject is uncovered and all the remaining portions of the subject are blanked out. Preferably a black mask is used for the exposure forming the negative image and a white mask is used for the exposure forming the positive image. This is much simpler and more convenient than forming separate positive and negative photographs and forming a composite by physically deleting and inserting portions to obtain the desired physical relationship.

My photographic elements can be developed following exposure in any desired conventional manner using an internal developer. Such developers are those conventionally used to develop internal latent image emulsions. One such developer is Kodak Developer D-19 modified by the inclusion of iodide, described above in connection with the identification of internal image silver halide grains useful in the practice of my invention. Other internal developers are described in the internal image emulsion patents cited above incorporated by reference into this disclosure.

The following examples are included for a further understanding of my invention.

EXAMPLES

A 0.2 micron cubic silver bromoiodide emulsion was chemically finished to fog by adding 2.5 mg of thiourea dioxide per silver mole and heating at 65°C for 60 minutes. Then 0.25 mg of potassium chloroaurate was added and the emulsion heated at 65°C for 70 minutes. The emulsion was then used as the nuclei for a second precipitation in which equal molar solutions of silver nitrate and potassium bromide were added over a period of 60 minutes at 70°C while maintaining the pAg at 9.3. The resulting emulsion was comprised of octahedral crystals of an average diameter of 0.35 micron. To 28 gms of the emulsion (1.12 Kg of emulsion per mole of silver and 80 g of gel/mole of silver) was added the following:

1. 34 g of a 10 percent aqueous gelatin solution,
2. 64 g of distilled water,
3. 1 g of a 15 percent aqueous saponin solution,
4. 0.5 g of a 3 percent mucochloric acid solution, and
5. sufficient spectral sensitizing dyd and/or desensitizer to provide a 25 percent grain coverage of each (100 mg/mole of silver).

Samples of the above emulsions were then added on a film support at 200 mg of silver/ft$^2$ and 400 mg of gelatin/ft$^2$, exposed using an Eastman 1B Sensitometer set for ½ second exposures and a slit width of 0.5 nm, developed for 6 minutes in Kodak Developer D-19 containing 0.5 g of potassium iodide/liter, fixed, washed and dried. The following results were observed:

TABLE I

| Example No. | Spect. Sens. Dye | Desensitizer | Region of Negative Image (nm) | Region of Positive Image (nm) |
|---|---|---|---|---|
| Control-1 | None | None | 400–470 | None |
| Control-2 | SS-I | None | 400–470 and 560–580 | None |
| Control-3 | None | DS-II | None | 400–470 and 580–700 |
| Control-4 | None | DS-III | None | 400–470 and 500–600 |
| 1 | SS-I | DS-II | 400–470 and 560–580 | 600–690 |
| 2 | SS-I | DS-III | 400–470 and 560–580 | 480–560 |
| Control-5 | SS-I | DS-IV | None | 560–590 |
| Control-6 | SS-I | DS-V | 400–470 | None |
| Control-7 | SS-I | DS-VI | 400–470 | None |
| Control-8 | SS-I | DS-VII | 400–470 | None |

TABLE II

| Descriptor | Name | Potentials (volts) Oxidation | Reduction |
|---|---|---|---|
| SS-I | 1,1'-diethyl-2,2'-cyanine chloride | +0.99 | −1.01 |
| DS-II | 1,1',3,3'-tetraphenyl-5,5',6,6'-tetrachloroimidazo-[4,5-b]quinoxalinocarbocyanine p-toluenesulfonate | +1.00 | −0.45 |
| DS-III | 1,3-diethyl-1'-methyl-2'-phenylimidazo[4,5-b]-quinoxalino-3'-indolo carbocyanine iodide | +1.00 | −0.63 |
| DS-IV | 5-m-nitrobenzylidene rhodanine | +0.44 | −0.35 |
| DS-V | 2,2'-diethyl-5,5'-dinitrothiocarbocyanine chloride | +0.96 | −0.58 |
| DS-VI | 1,1'-diethyl-6,6'-dinitro-2,2'-cyanine iodide | +1.00 | −0.55 |
| DS-VII | 1,1',3,3'-tetraethylimidazo[4,5-b]quinoxalino-tricarbocyanine pts | +0.41 | −0.58 |

In looking at Table I is it apparent that the emulsion employed exhibited a native sensitivity in the range of from 400 to 470 nm without sensitization. The spectral sensitizing die SS-I sensitized the emulsion to the green portion of the spectrum in the range of from 560 to 580 nm when no desensitizer was present. On the other hand, using the desensitizers DS-II and DS-III chosen according to my invention without a spectral sensitizer being present, the native negative sensitivity of the emulsion was destroyed, and the emulsion produced positive images when exposed to radiation in the range of from 440 to 470 nm. In addition, with DS-II an additional reversal sensitization in the range of from 580 to 700 nm was created using the desensitizer along. When the spectral sensitizer SS-I and DS-II were present in combination, the native spectral sensitivity of the emulsion returned and the negative sensitivity observed using the spectral sensitizer along was also observed. The reversal sensitivity of from 600 to 690 nm was only slightly less than when the desensitizer was present alone. Using SS-I and DS-III together, a positive image in the range of from 480 to 560 nm was produced, falling between the range of native negative sensitivity and the range of negative sensitivity produced by the spectral sensitizing dye.

To illustrate the ability of my photographic elements to form positive and negative images as a function of the desensitizer chosen, DS-IV, DS-V, DS-VI and DS-VII were also examined in combination with the spectral sensitizer SS-I. One of these combinations gave only positive images while the remainder gave only negative images. The failure of DS-VII to give positive images is to be particularly noted since this desensitizer contained two imidazoquinoxaline nuclei. The failure of this desensitizer demonstrates the requirement for oxidation potentials above +0.80 volt.

The invention has been described with particular reference to preferred embodiments thereof but it will be understood that variations and modifications can be effected within the spirit and scope of the invention.

I claim:

1. A photographic element capable of forming either a positive or a negative image, depending upon the choice of electromagnetic radiation wavelengths to which it is exposed, comprising a support and, as a coating thereon, a layer comprising internally fogged photographic silver bromide grains which are substantially free of surface fog and, associated with the surface of said grains, a desensitizer containing an imidazoquinoxaline nucleus having a reduction potential more positive than −0.90 volt and an oxidation potential more positive than +0.80 volt, said desensitizer being present in a desensitizing amount sufficient to cover no more than 25 percent of the surface of said silver bromide grains, at least 0.5 times the amount of said desensitizer of a spectral sensitizing dye having an absorption peak at least 20 nm removed from any absorption peak exhibited by said desensitizer, and said silver bromide grains being chosen so that prior to association with said sensitizing dye and desensitizer a test coating thereof with no image exposure and development for about 5 minutes at 20°C using Kodak Developer D-19 will provide a density of less than 0.4 and, when said test coating is developed, but with the developer containing 0.50 grams of potassium iodide per liter of developer, it will have a maximum density greater than 0.5.

2. A photographic element according to claim 1 in which said desensitizer contains two imidazoquinoxaline nuclei.

3. A photographic element according to claim 1 in which said photographic silver bromide consists essentially of a fogged photosensitive silver bromide core having thereon a shell of photosensitive silver bromide substantially free of surface fog.

4. A photographic element according to claim 1 in which said desensitizer is a cyanine or merocyanine dye containing two desensitizing nuclei.

5. A photographic element according to claim 4 in which said desensitizer is chosen from among compounds having the formula

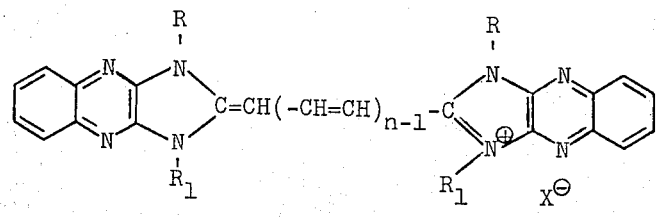

and

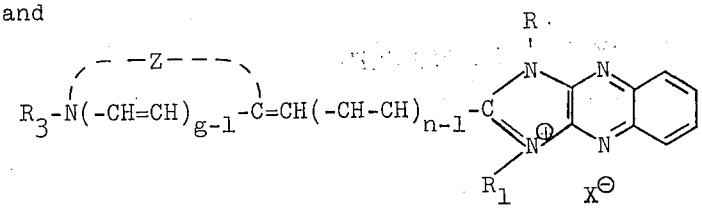

wherein $n$ represents a positive integer of from 2 to 4;

g has the value of 1 or 2;

R and $R_1$ are independently chosen from among alkyl substituents having from 1 to 18 carbon atoms; alkenyl substituents having from 1 to 18 carbon atoms and aryl substituents having from 6 to 10 carbon atoms;

$R_3$ represents an alkyl group having from 1 to 12 carbon atoms;

Z represents the monmetallic atoms necessary to complete a heterocyclic nucleus containing 5 to 6 atoms in the heterocyclic ring; and $X^-$ represents an anion.

6. A photographic element according to claim 1 in which said desensitizer has an oxidation potential more positive than +0.90 volt.

7. A photographic element according to claim 6 in which said desensitizer has an oxidation potential more positive than +1.00 volt.

8. A photographic element according to claim 1 in which said test coating with no image exposure and development for about 5 minutes at 20°C using Kodak Developer D-19 will provide a density of less than 0.25.

9. A photographic element according to claim 1 in which said spectral sensitizing dye has a reduction potential more negative than −0.90 volt and an oxidation potantial less positive than +1.00 volt.

10. A process of selectively forming either a positive or a negative photographic image comprising providing as a coating of a photographic element a composition comprising (1) internally fogged photographic silver bromide grains which are substantially free of surface fog and, associated with the surface of said grains, (2) a desensitizing amount sufficient to cover no more than 25 percent of the surface of said silver halide grains of a desensitizer having a reduction potential more positive than ±0.80 volt and (3) at least 0.5 times the amount of said desensitizer of a spectral sensitizing dye having an absorption peak at least 20 nm removed from any absorption peak exhibited by said desensitizer, said silver bromide grains being chosen so that prior to association with said sensitizing dye and desensitizer a test coating thereof with no image exposure and development for about 5 minutes at 20°C using Kodak Developer D-19 will provide a density of less than 0.4 and, when said test coating is developed, but with the developer containing 0.50 grams of potassium iodide per liter of developer, it will have a maximum density greater than 0.5;

selectively exposing said coating to electromagnetic radiation within a wavelength range within which the silver bromide grain surfaces are predominantly desensitized or selectively exposing said coating to electromagnetic radiation within a wavelength range within which the silver bromide grain surfaces are predominantly sensitized;

and then developing with an internal image developer to form an image.

11. A process according to claim 10 in which the silver halide grains are exposed within a portion of the electromagnetic spectrum to which they exhibit native sensitivity in order to obtain a negative image.

12. A process according to claim 11 in which the silver halide grains are exposed to radiation within that portion of the spectrum to which the sensitizing dye exhibits peak absorption in order to obtain a negative image.

13. A process according to claim 12 in which the silver bromide grains are exposed to radiation within that portion of the spectrum to which the desensitizer exhibits peak absorption in order to obtain a positive image.

14. A process according to claim 10 in which the internal image developer contains iodide ions.

15. A process according to claim 14 in which the internal image developer is of the composition

| | |
|---|---|
| N-methyl-p-aminophenol sulfate | 2.0 g |
| sodium sulfite | 90.0 g |
| hydroquinone | 8.0 g |
| sodium carbonate, monohydrated | 52.5 g |
| potassium bromide | 5.0 g |
| potassium iodide | 0.5 g |
| water to make | 1.0 liter. |

* * * * *